United States Patent [19]

Rizzardi

[11] Patent Number: 5,047,064

[45] Date of Patent: Sep. 10, 1991

[54] METHOD AND COMPOSITION FOR THE ALKALI TREATMENT OF CELLULOSIC SUBSTRATES

[75] Inventor: Angelo Rizzardi, Matthews, N.C.

[73] Assignee: Sandoz Ltd., Basel, Switzerland

[21] Appl. No.: 393,345

[22] Filed: Aug. 14, 1989

Related U.S. Application Data

[63] Continuation of Ser. No. 57,455, Jun. 3, 1987, abandoned, which is a continuation of Ser. No. 726,630, Apr. 24, 1985, abandoned, which is a continuation-in-part of Ser. No. 546,859, Oct. 31, 1983, abandoned.

[51] Int. Cl.[5] ..... D06M 11/38

[52] U.S. Cl. ..... 8/125; 8/116.1; 8/127

[58] Field of Search ..... 8/115.68, 125, 127

[56] References Cited

FOREIGN PATENT DOCUMENTS 1237554 6/1971 United Kingdom .
2104561 3/1983 United Kingdom .

*Primary Examiner*—Prince E. Willis
*Assistant Examiner*—John F. McNally
*Attorney, Agent, or Firm*—Gerald D. Sharkin; Richard E. Vila; Thomas C. Doyle

[57] ABSTRACT

A method is provided for improving the dyeability and other properties of cellulosic materials, especially knitted cotton goods, wherein the material is impregnated with an aqueous liquor containing an effective amount of potassium hydroxide and preferably also an alkali metal silicate, a wetting agent and a sequestering agent, at a temperature of at least about 7° C. (45° F.). The application of tension is not necessary and the treatment is particularly useful for tubular knitted goods.

53 Claims, No Drawings

METHOD AND COMPOSITION FOR THE ALKALI TREATMENT OF CELLULOSIC SUBSTRATES

This is a continuation of application Ser. No. 07/057,455, filed June 3, 1987, now abandoned which in turn is a continuation of application Ser. No. 07/726,603, filed Apr. 24, 1985, now abandoned which in turn is a continuation-in-part of application Ser. No. 06/546,859, filed Oct. 31, 1983, now abandoned.

The present invention provides a composition for the alkali treatment of a cellulosic substrate and a method for such treatment which comprises applying the composition to such a substrate.

The composition of the present invention is an aqueous liquor containing as an essential component potassium hydroxide.

The treatment liquor may contain, in addition to the potassium hydroxide, other alkali metal hydroxides, such as sodium hydroxide. However, at least 75%, by weight, of the total alkali metal content must be potassium hydroxide. Preferably, potassium hydroxide is the sole alkali metal hydroxide present.

The amount of alkali metal hydroxide in the treatment liquor should be enough to improve the dyeability of the cellulosic substrate and is preferably in the range about 120 to 400 g/l more preferably about 200 to 330 g/l most preferably 240 to 300 g/l. The alkalinity of the treatment liquor desirably is in the range of about 18° to 30° Bé, especially about 20° to 27° Bé.

In addition to the alkali metal hydroxide the treatment liquor preferably contains an alkali metal silicate. More preferably, the alkali metal silicate is sodium or potassium silicate.

The amount of alkali metal silicate present is generally up to about 100 g/l and is preferably in the range about 5 to 85 g/l, more preferably 10 to 70 g/l, most preferably 15 to 35 g/l, the amount being such that the alkalinity of the treatment liquor will be as stated above.

The ratio of alkali metal hydroxide to alkali metal silicate may range from about 2:1 to 20:1, preferably about 4:1 to 16:1, more preferably about 6:1 to 13:1, by weight.

A further preferred constituent of the alkali treatment liquor is a wetting agent.

Preferred wetting agents are anionic, non-ionic or amphoteric surfactants which are stable to aqueous potassium hydroxide in the amounts employed. Such compounds are known and commercially available. More preferably the wetting agent is of the anionic type, optionally in the form of a mixture with one or more other anionic wetting agents or with a non-ionic or amphoteric wetting agent. Suitable anionic wetting agents include:

i) sulphated $C_{4-24}$ alcohols or glycols, optionally ethoxylated with 2 to 25 ethyleneoxy units;
ii) alkyl $C_{7-20}$ phosphoric acid esters or semi-esters;
iii) alkyl $C_{1-20}$ poly (1−25) glycol ether phosphoric acid esters;
iv) arylsulphonates, e.g., cumenesulphonates;
v) sulphated fatty acids, e.g., sulphated aliphatic saturated or unsaturated fatty acids, preferably $C_{16-18}$ fatty acids,
vi) sulphated fatty acid esters, mono- or diamides;
vii) sulphonated fatty acid mono- or diamides, and
viii) carboxymethylated addition products of 1 to 25 moles of ethylene oxide to a $C_{4-24}$ alcohol Preferred anionic wetting agents are those of types i), iii), iv) and vii) above. The most preferred anionic wetting agent is sodium 2-ethylhexyl sulphate.

The amount of wetting agent, when present, should be sufficient to promote uniform impregnation of the substrate with the treatment liquor during the application step and is generally up to about 20 g/l, preferably 0.1 to 10, more preferably 0.5 to 7.5, most preferably 1 to 5 grams, per liter of treatment liquor.

A further preferred component of the treatment liquor is an alkali-resistant agent capable of sequestering or complexing with heavy metal ions. It is believed that such an agent inhibits the formation of less water-soluble metal silicates which might interfere with the removal of the alkali metal silicate during the rinsing of the substrate which follows the alkali treatment step. Compounds useful for tying up heavy metal ions in aqueous media are known. The preferred such compounds for use in the process of the present invention are alkali metal salts of hydroxycarboxylic acids, particularly pentonic, hexonic and heptonic acids, and more particularly gluconic acid, especially sodium gluconate. Other compounds known to be useful as cation sequestering agents include alkali metal glucoheptonates and alkali metal salts of nitrilocarboxylic acids and of ethylenediamine-tetraacetic acid.

The sequestering or complexing agent is conveniently added to the treatment liquor in an amount which may range up to about 40 g/l, depending, for instance on the hardness of the water. Preferably the amount of this component is in the range about 0.2 to 20, more preferably about 0.5 to 10, most preferably 2.5 to 5 g/l.

The metal-sequestering or complexing agent is conveniently added to the treatment liquor in admixture with a dispersing agent, preferably an anionic dispersant, such as a sulphonated fatty acid amide, of which the most preferred is 1-propane sulphonic acid, 2-hydroxy-3-[(2-hydroxyethyl)[2-[(1-oxo-9-octadecenyl-)amino]ethyl]amino], monosodium salt. A particularly preferred mixture, which is also useful as a stabilizer for preventing too rapid release of oxygen during peroxide bleaching, comprises, by weight, 15% sodium gluconate, 5% 1-propane sulphonic acid, 2-hydroxy-3-[(2-hydroxyethyl)[2-[1-oxo-9-octadecenyl)amino]ethyl-]amino]-, monosodium salt, 1% hexylene glycol, 1.75% isopropanol (91%), 4% magnesium chloride and the balance water. When this stabilizing agent is employed, the amount is preferably in the range 1 to 20, more preferably 3 to 15, most preferably 5 to 10 g/l, based on the weight of the components other than water.

It is also advantageous to include in the alkali treatment liquor a compound having textile lubricating as well as dispersing properties, and particularly such compounds which have the further property of acting as retarding leveling agents for reactive dyes. Anionic compounds are preferred, especially sulphonated or sulphated castor oil. The amount of such a compound is preferably 0.1 to 15, more preferably 1 to 15 grams per liter of alkali treatment bath.

The aqueous alkali treatment liquor is applied to the substrate at a temperature which is above 45° F. and is generally in the range about 50° to 212° F. Preferably the temperature is in the range 65°-175° F., most preferably 68°-95° F.

The liquor can be applied to the substrate by various methods, such as spraying, foam application or immersion. Preferably, the liquor is applied by padding.

By controlling the rate of initial application and/or by removing excess liquor, as by squeezing, a pick-up of about 70 to 180%, more preferably 80 to 150%, most preferably 90 to 140% is achieved.

When the alkali treatment liquor is applied in the form of a foam, techniques similar to those known in the art for effecting various textile treatments can be employed. Of course, the amount of foam applied will be sufficient to bring into contact with the substrate an amount of alkali treatment components equivalent to those applied e.g. by padding.

Following the impregnation with the treatment liquor, the substrate is allowed to dwell for a period of time sufficient to permit the components of the liquor to act on the cellulosic material. Normally, the dwell time is at least about 0.5 hour, preferably about 0.5 to 10 hours, more preferably about 1 to 4 hours. This can be conveniently effected by winding the impregnated substrate on a beam, which is optionally rotated during the dwelling. Alternatively, the goods may be stored in any suitable receptacle during the dwelling period. Dwelling is normally effected at ambient temperature, e.g. 65° to 95° F., preferably 70° to 85° F.

With bulkier materials, such as corduroy, it may not be practical to effect a dwelling in the manner described above. Rather, it is preferred to carry out the process in a continuous manner with the material being drawn from the application, e.g. padding, operation to a rinsing operation at such a rate as to allow for a relatively brief interval between these operations for the treatment liquor components to act on the material. Depending on the equipment used and the space available, this brief dwelling interval will be at least about 10 seconds, preferably about 15 to 120 seconds, and most preferably about 30 to 60 seconds. In order to accelerate the action of the treatment liquor components on the substrate, moist heat, e.g. steam, or dry heat e.g. at 180°-220° F. may be employed.

Following the dwelling, the substrate can be washed, bleached and dried in conventional fashion. Washing is generally effected with water, preferably softened or demineralized, at room temperature to boiling, preferably at about 149° to 200° F. The bleaching can be effected with a conventional peroxide bleaching composition.

The substrate treated according to the present invention can be a blend of cellulosic fibers with other fibers, e.g., polyester. Preferably, the substrate is 100% cellulosic, more preferably cotton. Furthermore the substrate can be in a variety of forms, e.g., woven, knitted or yarn. It is a particular advantage of the process of the invention that it can be used for the alkali treatment of knitted goods, more particularly tubular knitted goods. Corduroy is another material for which the alkali treatment of this invention is especially advantageous.

Cellulosic fiber goods treated with a composition or process according to the invention have a smooth appearance with increased luster (gloss), tensile strength, and elongation strength and stability. They are also characterized by their improved dyeability, e.g., with reactive dyes. It has also been observed that the treated goods undergo substantially less shrinkage than is usually experienced in alkali treatments of cellulosic materials wherein the sole or major alkali metal hydroxide component is sodium hydroxide.

Because of the aforementioned reduced shrinkage, it is a further advantage of this invention that the process can be effected without the need for having the goods under tension (except the normal lengthwise tension exerted when the material is drawn between rollers during treatment). Thus, the need for a tenter frame to keep the material under tension is avoided and the process can be employed for the treatment of tubular knitted goods. The reduced shrinkage also makes this process attractive for the treatment of pile-surfaced substrates, such as corduroy.

In the following Examples, all parts and percentages are by weight and all temperatures are in degrees Fahrenheit, unless otherwise indicated.

EXAMPLES

Preparation of Treatment Baths

Alkaline treatment baths are made up as follows:

Half of the final bath volume of soft water at a temperature of 80°-90° F. is poured into the bath and the required amount of potassium hydroxide is added and stirred. The silicate is then stirred in, followed by the sodium gluconate—containing stabilizer specifically described above and the wetting agent, sodium 2-ethylhexyl sulphate. Finally, the bath volume is made up to the required amount by the addition of cold soft water.

The composition of each bath is given in Table 1 below.

TABLE 1

| | Bath 1 | Bath 2 | Bath 3 |
|---|---|---|---|
| KOH (dry wt.) | 200 g/l | 200 g/l | 250 g/l |
| Potassium Silicate (30%) | 75 g/l | | 75 g/l |
| Sodium Silicate (30%) | | 75 g/l | |
| Wetting Agent (17%) | 10 g/l | 10 g/l | 20 g/l |
| Stabilizer | 30 g/l | 30 g/l | 30 g/l |

EXAMPLE 1 a) A flattened length of tubular knit grey (unbleached) cotton is continuously drawn from a basket through Bath 1 above, which is at approximately room temperature. The immersion time in the bath is about 1 to 2 seconds. The wetted substrate is then squeezed between a pair of rollers to a wet pick-up of about 90%. During this sequence the only tension on the cotton substrate is that caused by the lengthwise pulling of said substrate from its initial slack position in the basket through the nip of the squeezing rollers at a speed of about 10 yards per minute. The wetted substrate is then fed into a second basket where it is allowed to dwell in a tension-free condition for a period of about two hours at room temperature.

b) The above-treated substrate is then washed continuously for about 5 to 10 minutes with water at about 160°-180° F., treated with sufficient aqueous acetic acid to neutralize any residual alkali and washed again briefly with water to remove any excess acetic acid. The substrate is squeezed between rollers to a moisture content of approximately 80% and passed for about 5 to 10 seconds through a peroxide saturation bath which typically contains about 20-30 g/l caustic soda (100%), 4.5 g/l surfactant, 3-4 g/l chelating agent, 50-70 g/l sodium silicate and 30-50 g/l hydrogen peroxide and which is at a temperature of about 120°-130° F. The material is again squeezed between rollers to ensure uniform distribution of the peroxide solution and then drawn into a J box where it is subjected to steam at about 200° to 212° F. for about 90 minutes. The substrate is then washed with water at about 160° to 180° F. to remove any residual peroxide solution components, squeezed through rollers and dried by passage over heated perforated cylinders in conventional manner. During this sequence of steps the substrate is essentially under only that amount of tension created by the rollers drawing it from its tension-free condition in the dwelling basket and in the J box.

EXAMPLE 2

A flattened length of tubular knit grey cotton is treated as described in paragraphs a) and b) of Example 1, except that it is immersed in Bath 2 instead of Bath 1.

EXAMPLE 3

A flattened length of tubular knit grey cotton is treated as described in paragraphs a) and b) of Example 1, except that it is immersed in Bath 3 instead of Bath 1.

Comparative Example C1

A substrate identical to that treated in Examples 1 and 2 is treated only according to paragraph b) of Example 1.

Compared to this Sample C1, the shrinkage of the substrates of Examples 1 and 2 is set forth in Table 2.

TABLE 2

| | Width | Length |
|---|---|---|
| Ex. 1 | 1% | 7% |
| Ex. 2 | 2% | 3.5% |

Comparative Example C2

A substrate identical to that treated in Example 3 is treated only according to paragraph b) of Example 1.

Compared to this Sample C2, the shrinkage of the substrate of Example 3 was about 0.6% in width and 8.5% in length.

Affinity for Reactive Dyes

The substrates treated according to Examples 1 and 2 and C1 were dyed under identical conditions with the same reactive dye by the pad batch method.

Compared to C1 the substrate of Example 1 exhibited 23.7% greater dye affinity and the substrate of Example 2 exhibited 13.9% greater dye affinity.

The substrate treated according to Examples 3 and C2 were dyed under identical conditions with the same reactive dye by the pad batch method. Compared to C2 the substrate of Example 3 exhibited more than 40% greater dye affinity.

Wash Shrinkage

The dyed substrates of Examples 1 and 2 and C1 were laundered and tumbled dry under identical conditions. The shrinkage which took place during this treatment is set forth in Table 3.

TABLE 3

| | Width | Length | Overall |
|---|---|---|---|
| Ex. 1 | 8.8% | 10% | 17.9% |
| Ex. 2 | 8.8% | 11.3% | 19% |
| Ex. C1 | 11.3% | 8.8% | 19% |

The dyed substrate of Examples 3 and C2 were laundered and tumbled dry under identical conditions. The shrinkage which took place during this treatment is set forth in Table 4.

TABLE 4

| | Width | Length | Overall |
|---|---|---|---|
| Ex. 3 | 7.8% | 8.8% | 15.6% |
| Ex. C2 | 11.0% | 12.2% | 21.8% |

EXAMPLE 4

A continuous length of tubular single knit grey cotton jersey is drawn open width at a speed of about 50 yds./-min. over a series of rollers, through a treatment bath, through a pair of squeeze rollers and onto a perforated roller. During this passage the material is under tension only in a lengthwise direction.

The temperature of the treatment bath is 78° F. and its composition is as follows: 270 g/l potassium hydroxide (as 90% flakes), 75 g/l sodium silicate (as a 42° Bé aqueous solution); 15 g/l of the sodium gluconate-containing stabilizer specifically described above; 5 g/l sulphonated castor oil (35% active) and 3 g/l sodium 2-ethylhexyl sulphate (about 20% active).

A bubble of air is maintained in the length of tubular material between a roller in the treatment bath and the squeeze rollers.

The speed of travel of the material and the pressure of the squeeze rollers in such as to give a wet pick-up of about 116%, based on the weight of the material.

The impregnated material is allowed to dwell on the perforated roller for about 2 hours at room temperature.

Following the dwelling, the material is treated as in paragraph b) of Example 1.

The thus-treated substrate is characterized by improved luster and dyeability along with very good hand and stretchability.

EXAMPLE 5

The procedure of Example 4 is repeated except that the pick-up is about 130% and the treatment liquor comprises: 250 g/l potassium hydroxide (100%); 130 g/l sodium silicate (30%); 15 g/l sodium gluconate-containing stabilizer composition; 7 g/l sulphonated castor oil (35%); and 12 g/l sodium 2-ethylhexyl sulphate (20%).

The resulting knitted cotton substrate has good luster, dyeability, and dimensional stability.

What is claimed is:

1. A method for the alkali treatment of a 100 percent cotton or cotton-polyester blend substrate which comprises applying to said substrate an aqueous alkali liquor having a temperature of above 45° F. and containing potassium hydroxide and an alkali metal silicate, said potassium hydroxide being present in an amount in the range 120 to 400 g/l sufficient to improve the dyeability of the substrate and being the sole alkali metal hydroxide present.

2. A method according to claim 1 in which the strength of aqueous alkali is in the range 18° to 30° Bé.

3. A method according to claim 1 in which the amount of alkali metal silicate in the aqueous alkali liquor is in the range 5 to 85 g/l.

4. A method according to claim 1 in which the aqueous alkali liquor contains a wetting agent.

5. A method according to claim 1 in which the aqueous alkali liquor contains a alkali-resistant heavy metal ion-sequestering or-complexing agent.

6. A method according to claim 1 in which the substrate is knitted 100% cotton goods.

7. A method according to claim 1 wherein, following application of the aqueous alkali liquor, the substrate is dwelled for a period of time sufficient for the treatment liquor components to act on the substrate and is then washed with water to remove the potassium hydroxide.

8. A method according to claim 7 in which the aqueous alkali liquor contains an anionic wetting agent.

9. A method according to claim 8 wherein, during the application, dwelling and washing steps, the substrate is free from tension across its width.

10. A method according to claim 5 wherein, following application of the alkali liquor, the substrate is dwelled for a period of time sufficient for the treatment liquor components to act on the substrate and is then washed with water to remove the alkali metal hydroxide.

11. A method according to claim 10 during the application, washing and dwelling steps, the substrate is free from tension across its width.

12. A 100% cotton or cotton-polyester blend fiber substrate treated according to the method of claim 1.

13. A method according to claim 1 in which the amount of potassium hydroxide in the aqueous alkali liquor is in the range about 200 to 300 g/l.

14. A method according to claim 1 in which the weight ratio of potassium hydroxide to alkali metal silicate is in the range 2:1 to 20:1.

15. A method according to claim 1 in which the amount of potassium hydroxide in the aqueous alkali liquor is in the range about 200 to 330 g/l and the weight ratio of potassium hydroxide to alkali metal silicate is in the range 2:1 to 20:1.

16. A method according to claim 5 in which the amount of potassium hydroxide in the aqueous alkali liquor is in the range about 200 to 330 g/l, the amount of metal ion-sequestering or complexing agent is about 0.2 to 20 g/l and the weight ratio of potassium hydroxide to alkali metal silicate is in the range 2:1 to 20.1.

17. A method according to claim 7 in which the amount of potassium hydroxide in the aqueous alkali liquor is in the range about 200 to 330 g/l and the weight ratio of potassium hydroxide to alkali metal silicate is in the range 2:1 to 20:1.

18. A method according to claim 9 in which the amount of potassium hydroxide in the aqueous alkali liquor is in the range about 200 to 330 g/l and the weight ratio of potassium hydroxide to alkali metal silicate is in the range 2:1 to 20:1.

19. A method according to claim 13 in which the substrate is in the form of knitted goods.

20. A method according to claim 15 in which the substrate is in the form of knitted goods.

21. A method according to claim 16 in which the substrate is in the form of knitted goods.

22. A method according to claim 17 in which the substrate is in the form of tubular knitted goods.

23. A method according to claim 18 in which the substrate is in the form of tubular knitted goods.

24. A method according to claim 18 in which the aqueous alkali liquor contains an alkali resistant heavy metal ion-sequestering or -complexing agent.

25. A method according to claim 16 in which the aqueous alkali liquor contains a wetting agent in an amount sufficient to promote uniform impregnation of the substrate during application.

26. A method according to claim 17 in which the aqueous liquor contains a wetting agent in an amount sufficient to promote uniform impregnation of the substrate during application.

27. A method according to claim 21 in which the aqueous alkali liquor contains a wetting agent in an amount sufficient to promote uniform impregnation of the substrate during application.

28. A method according to claim 22 in which the aqueous alkali liquor contains a wetting agent in an amount sufficient to promote uniform impregnation of the substrate during application.

29. A method according to claim 25 wherein the wetting agent is anionic.

30. A method according to claim 26 wherein the wetting agent is anionic.

31. A method according to claim 27 wherein the wetting agent is anionic.

32. A method according to claim 28 wherein the wetting agent is anionic.

33. A method according to claim 7 which further comprises drying the washed substrate, said ;method being effected in the absence of tension across the width of the substrate.

34. A method according to claim 33 wherein the aqueous alkali liquor contains an alkali-resistant heavy metal ion-sequestering or -complexing agent.

35. A method according to claim 33 wherein the aqueous alkali liquor contains an anionic wetting agent.

36. A method according to claim 34 wherein the aqueous alkali liquor contains an anionic wetting agent.

37. A method according to claim 34 wherein the alkali-resistant heavy metal ion-sequestering or -complexing agent is selected from the group consisting of alkali metal salts or hydroxycarboxylic acids, nitrilocarboxylic acids and ethylene diamine tetraacetic acid and alkali metal glucoheptonates.

38. A method according to claim 33 wherein the substrate is in the form of tubular knitted goods.

39. A method according to claim 26 wherein the substrate is in the form of tubular knitted goods.

40. A method for the alkali treatment of a 100 percent cotton or cotton-polyester blend substrate which comprises applying to the substrate, at a temperature in the range 50° to 212° F., an aqueous alkaline treatment liquor comprising potassium hydroxide as sole alkali metal hydroxide, an alkali metal silicate and a wetting agent, the amount of alkali metal silicate being 10 to 70 g/l and the ratio of potassium hydroxide to alkali metal silicate being in the range 4:1 to 16:1, such that the alkalinity of the liquor is in the range 18° to 30° Be.

41. A method according to claim 40 wherein the wetting agent is anionic.

42. A method according to claim 40 wherein following the application of the treatment liquor the substrate is dwelled, then washed with water and dried, said method being effected in the absence of tension across the width of the substrate.

43. A method according to claim 42 wherein the substrate is in the form of tubular knitted goods.

44. A method according to claim 1 wherein the substrate is in the form of tubular knitted goods.

45. A method according to claim 1 wherein the substrate is 100% cotton.

46. A method according to claim 11 wherein the substrate is 100% cotton.

47. A method according to claim 19 wherein the substrate is 100% cotton.

48. a method according to claim 20 wherein the substrate is 100% cotton.

49. A method according to claim 48 wherein the substrate is in the form of tubular knitted goods.

50. A method according to claim 24 wherein the substrate is 100% cotton.

51. A method according to claim 39 wherein the substrate is 100% cotton.

52. A method according to claim 43 wherein the substrate is 100% cotton.

53. A method according to claim 44 wherein the substrate is 100% cotton.

* * * * *